US008065744B2

(12) United States Patent
Magno

(10) Patent No.: US 8,065,744 B2
(45) Date of Patent: Nov. 29, 2011

(54) PRACTICE GLOVE SYSTEM

(75) Inventor: Joseph Amerigo Magno, San Pedro, CA (US)

(73) Assignee: Joseph A. Magno, San Pedro, CA (US)

( * ) Notice: Subject to any disclaimer, the term of this patent is extended or adjusted under 35 U.S.C. 154(b) by 186 days.

(21) Appl. No.: 12/386,512

(22) Filed: Apr. 20, 2009

(65) Prior Publication Data

US 2010/0263101 A1 Oct. 21, 2010

(51) Int. Cl.
*A41D 13/08* (2006.01)

(52) U.S. Cl. ..... 2/19; 473/458

(58) Field of Classification Search ..... 2/16, 19, 2/18; 473/458, 425
See application file for complete search history.

(56) References Cited

U.S. PATENT DOCUMENTS

| | | | | | |
|---|---|---|---|---|---|
| 3,141,173 | A * | 7/1964 | Jackson et al. | ..... | 2/19 |
| 4,121,824 | A * | 10/1978 | Hirschfield | ..... | 473/458 |
| 4,637,610 | A * | 1/1987 | Carr | ..... | 473/458 |
| 4,817,209 | A * | 4/1989 | Lehmann et al. | ..... | 2/19 |
| 5,155,864 | A * | 10/1992 | Walker et al. | ..... | 2/18 |
| 5,976,036 | A * | 11/1999 | Jackson | ..... | 2/19 |
| 6,292,946 | B1 * | 9/2001 | Angione | ..... | 2/20 |

* cited by examiner

*Primary Examiner* — Danny Worrell

(57) ABSTRACT

A glove has fingers. The glove include a spaced thumb. The glove includes an arcuate lower edge. The glove includes an opening located centrally. The glove has upwardly projecting side edges. A web is secured between the thumb and fingers. In this manner an arcuate upper edge is formed. The glove has an insert. The insert has limited flexibility. The insert is in an arcuate configuration. The insert is secured within the glove. The insert has ends. A width line is provided between the ends. An enlarged pocket is provided in the glove. Stiffener is provided below and a width line above.

2 Claims, 3 Drawing Sheets

FIG 1
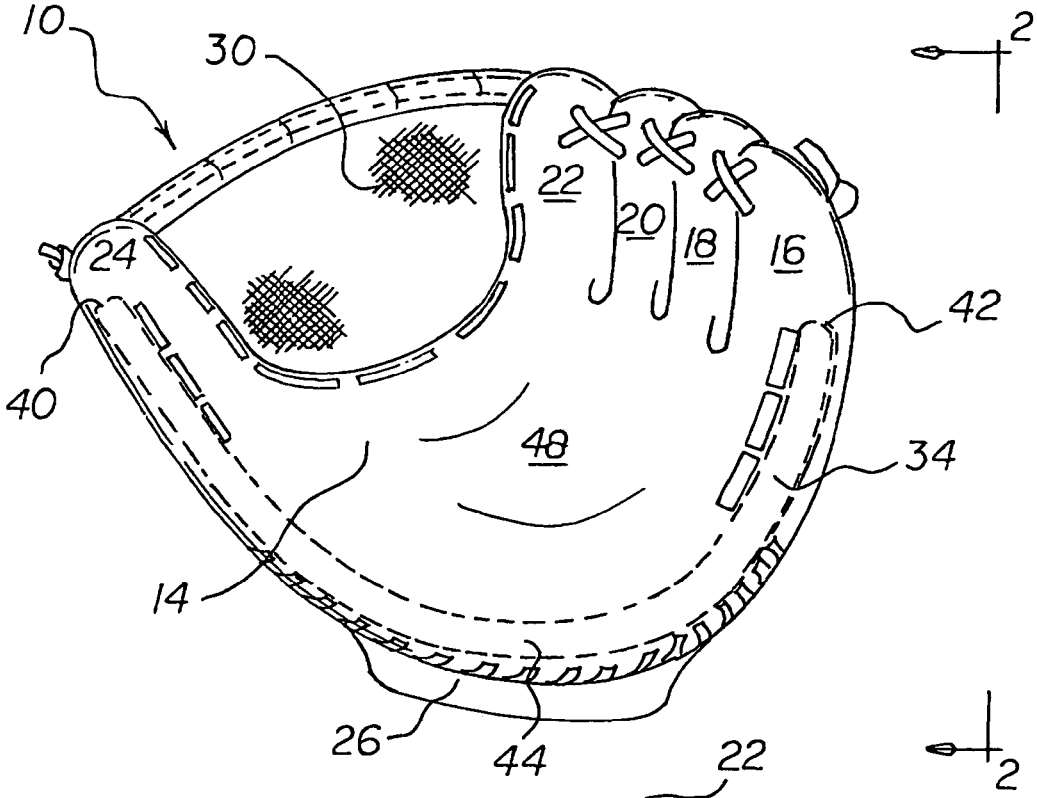
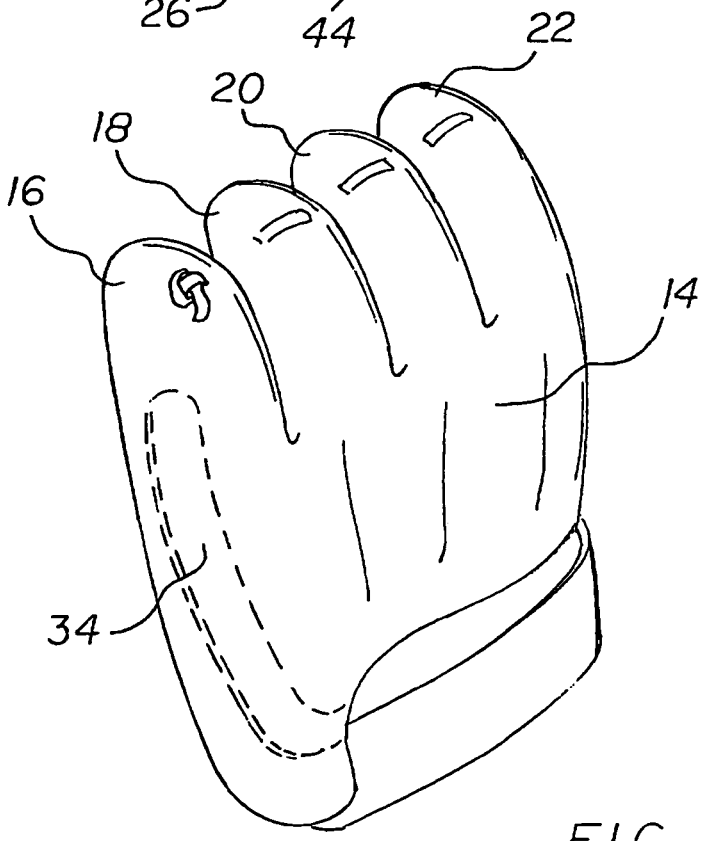
FIG 2

FIG 3
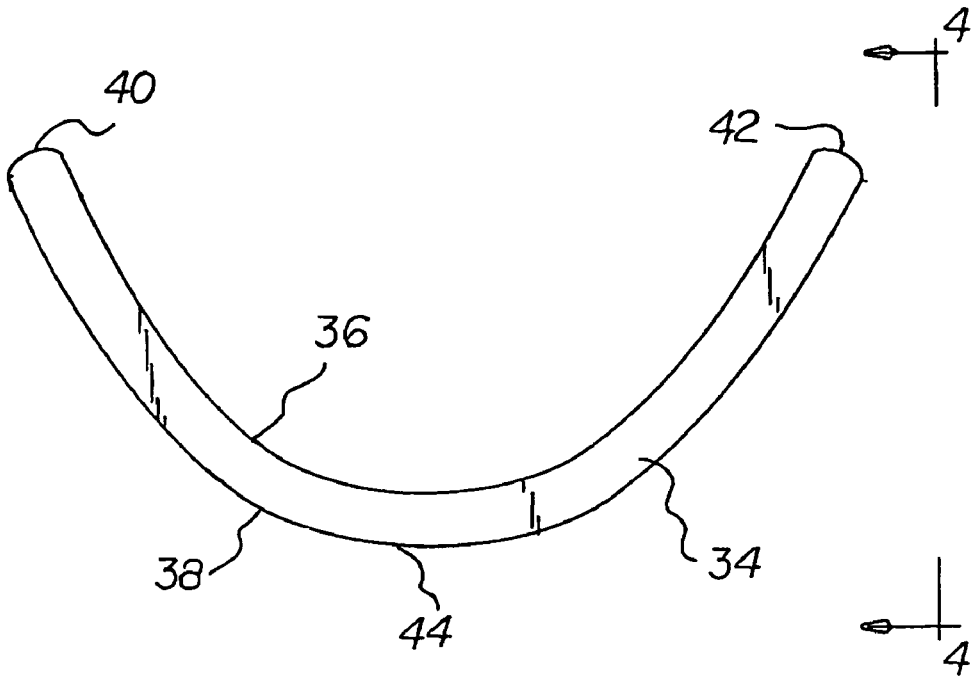
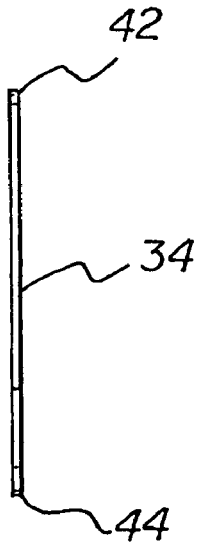
FIG 4

PRACTICE GLOVE SYSTEM

BACKGROUND OF THE INVENTION

1. Field of the Invention

The present invention relates to a practice glove system and more particularly pertains to training baseball players to field balls properly in a safe and reliable manner.

2. Description of the Prior Art

The use of glove systems of known designs and configurations is known in the prior art. More specifically, glove systems of known designs and configurations previously devised and utilized for the purpose of training baseball players to field balls through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,292,946 issued Sep. 25, 2001 to Angione relates to a Non-Resilient Insert for Catching Glove. U.S. Pat. No. 5,976,036 issued Nov. 2, 1999 to Jackson relates to a Baseball Glove Insert Training Aid. U.S. Pat. No. 4,121,824 issued Oct. 24, 1978 to Hirschfield relates to a Baseball Training Glove. Lastly, U.S. Pat. No. 3,141,173 issued Jul. 21, 1964 to Jackson relates to a Catcher's Mitt.

While these devices fulfill their respective, particular objectives and requirements, the aforementioned patents do not describe a practice glove system that allows for training baseball players to field balls properly in a safe and reliable manner.

In this respect, the practice glove system according to the present invention substantially departs from the conventional concepts and designs of the prior art, and in doing so provides an apparatus primarily developed for the purpose of training baseball players to field balls properly in a safe and reliable manner.

Therefore, it can be appreciated that there exists a continuing need for a new and improved practice glove system which can be used for training baseball players to field balls properly in a safe and reliable manner. In this regard, the present invention substantially fulfills this need.

SUMMARY OF THE INVENTION

In view of the foregoing disadvantages inherent in the known types of glove systems of known designs and configurations now present in the prior art, the present invention provides an improved practice glove system. As such, the general purpose of the present invention, which will be described subsequently in greater detail, is to provide a new and improved practice glove system and method which has all the advantages of the prior art and none of the disadvantages.

To attain this, the present invention essentially comprises a practice glove system. First provided is a glove. The glove is fabricated of a flexible material. The flexible material is selected from the class of flexible materials. The class of flexible materials includes animal hide and plastic. The glove has four adjacent fingers. The fingers include a little finger, a ring finger, a middle finger and an index finger. The fingers also include a spaced thumb. The thumb and fingers each have a short length of between about 3 inches and 4 inches. The glove has an arcuate lower edge. The arcuate lower edge has a hand opening. The hand opening is provided centrally. The glove has upwardly projecting side edges. The side edges extend into the thumb and little finger.

The glove also has a web. The web is secured between the thumb and index finger. In this manner an arcuate upper edge is defined across the thumb and web and fingers. The web is fabricated of two plies of woven nylon for increased hardness to function as a safety net for a player during use.

Further provided is an insert. The insert is fabricated of a plastic material. The plastic material has limited flexibility. The insert is provided in an arcuate configuration. The insert has a continuous arcuate radially interior edge. The insert has a continuous arcuate radially exterior edge. The insert has a continuous arcuate centerline. The centerline is equally spaced between the interior and exterior edges. The interior and exterior edges are equally spaced along their entire lengths. In this manner an insert width of between about 0.4 inches and 0.6 inches is defined. The center line has a length of between about 15 inches and 19 inches. The insert has a length of about 30 to 38 times its width. The insert is secured within the glove. The insert has a thumb end. The thumb end is located within the thumb. The insert has a little finger end. The little finger end is located within the little finger. The insert has a mid-region. The mid-region is located adjacent to the hand opening. In this manner the insert will preclude a player from bringing the thumb and little finger together for entrapment of a ball whereby a player will have to rely upon two handed ball deflecting and catching.

Provided last is an enlarged pocket in the glove. The enlarged pocket has a stiffener below and a width line above. The width line is a line of between about 10 inches and 12 inches. The width line couples the little finger end and the thumb end. The glove includes a height line between the upper and lower edges perpendicular with respect to the width line and crossing a central extent of the width line with the lower portion of the height line beneath the width line being between about 4 inches and 6 inches and the upper portion of the height line above the width line being shorter than the lower portion. The enlarged pocket is adapted to increase the area on the glove for deflecting a ball to be caught by two hands of a player.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved practice glove system which has all of the advantages of the prior art glove systems of known designs and configurations and none of the disadvantages.

It is another object of the present invention to provide a new and improved practice glove system which may be easily and efficiently manufactured and marketed.

It is further object of the present invention to provide a new and improved practice glove system which is of durable and reliable constructions.

An even further object of the present invention is to provide a new and improved practice glove system which is susceptible of a low cost of manufacture with regard to both materials and labor, and which accordingly is then susceptible of low prices of sale to the consuming public, thereby making such practice glove system economically available to the buying public.

Even still another object of the present invention is to provide a practice glove system for training baseball players to field balls properly in a safe and reliable manner.

Lastly, it is an object of the present invention to provide a new and improved practice glove system. A glove has fingers. The glove include a spaced thumb. The glove includes an arcuate lower edge. The glove includes an opening located centrally. The glove has upwardly projecting side edges. A web is secured between the thumb and fingers. In this manner an arcuate upper edge is formed. The glove has an insert. The insert has limited flexibility. The insert is in an arcuate configuration. The insert is secured within the glove. The insert has ends. A width line is provided between the ends. An enlarged pocket is provided in the glove. Stiffener is provided below and a width line above.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a practice glove system constructed in accordance with the principles of the present invention.

FIG. 2 is a side elevational view of the system taken along line 2-2 of FIG. 1.

FIG. 3 is a front elevational view of the insert illustrated in FIGS. 1 and 2.

FIG. 4 is a side elevational view of the insert taken along line 4-4 of FIG. 3.

The same reference numerals refer to the same parts throughout the various Figures.

DESCRIPTION OF THE PREFERRED EMBODIMENT

Figure 5:
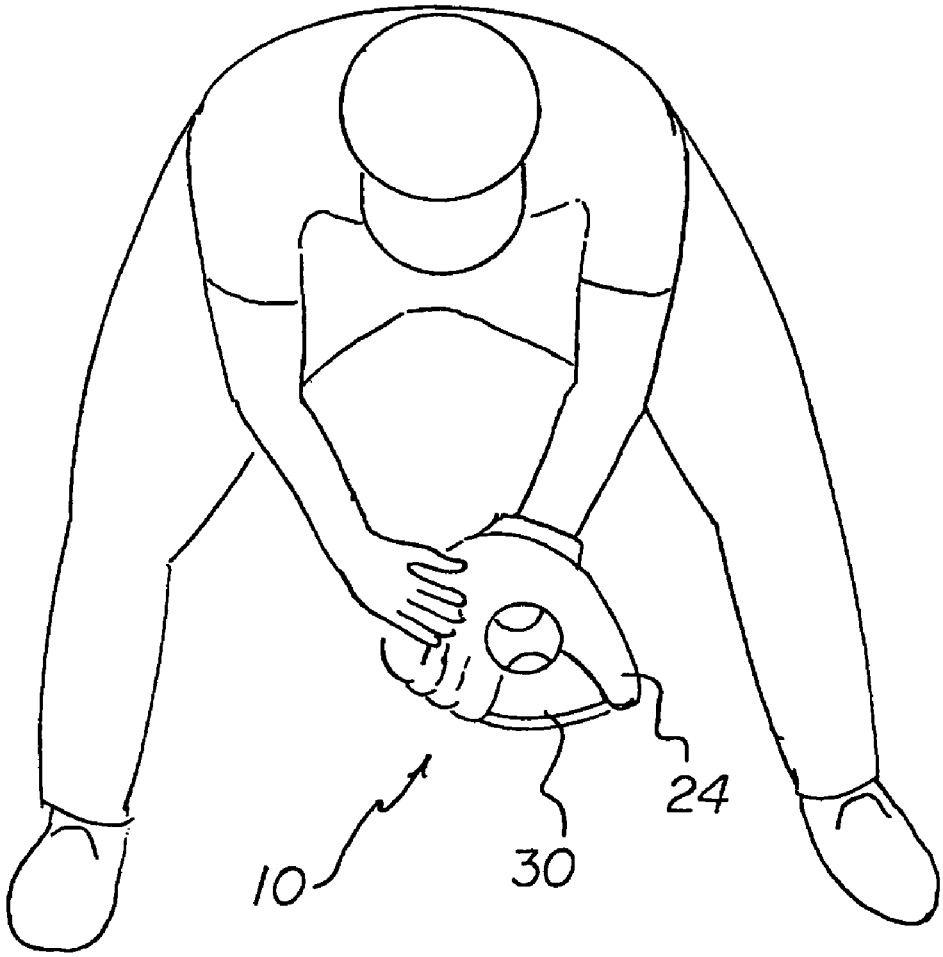
FIG. 5 is a perspective illustration of a practice glove system shown in the prior Figures during use.

With reference how to the drawings, and in particular to FIG. 1 thereof, the preferred embodiment of the new and improved practice glove system embodying the principles and concepts of the present invention and generally designated by the reference numeral 10 will be described.

The present invention, the practice glove system 10 is comprised of a plurality of components. Such components in their broadest context include a glove, a web, an insert and an enlarged pocket. Such components are individually configured and correlated with respect to each other so as to attain the desired objective.

First provided is a glove 14. The glove is fabricated of a flexible material. The flexible material is selected from the class of flexible materials. The class of flexible materials includes animal hide and plastic. The glove has four adjacent fingers. The fingers include a little finger 16, a ring finger 18, a middle finger 20 and an index finger 22. The fingers also include a spaced thumb 24. The thumb and fingers each have a short length of between about 3 inches and 4 inches. The glove has an arcuate lower edge. The arcuate lower edge has a hand opening 26. The hand opening is provided centrally. The glove has upwardly projecting side edges. The side edges extend into the thumb and little finger.

The glove also has a web 30. The web is secured between the thumb and index finger. In this manner an arcuate upper edge is defined across the thumb and web and fingers. The web is fabricated of two plies of woven nylon for increased hardness to function as a safety net for a player during use.

Further provided is an insert 34. The insert is fabricated of a plastic material. The plastic material has limited flexibility. The insert is provided in an arcuate configuration. The insert has a continuous arcuate radially interior edge 36. The insert has a continuous arcuate radially exterior edge 38. The insert has a continuous arcuate centerline. The centerline is equally spaced between the interior and exterior edges. The interior and exterior edges are equally spaced along their entire lengths. In this manner an insert width of between about 0.4 inches and 0.6 inches is defined. The center line has a length of between about 15 inches and 19 inches. The insert has a length of about 30 to 38 times its width. The insert is secured within the glove. The insert has a thumb end 40. The thumb end is located within the thumb. The insert has a little finger end 42. The little finger end is located within the little finger. The insert has a mid-region 44. The mid-region is located adjacent to the hand opening. In this manner the insert will preclude a player from bringing the thumb and little finger together for entrapment of a ball whereby a player will have to rely upon two handed ball deflecting and catching.

Provided last is an enlarged pocket 48 in the glove. The enlarged pocket has a stiffener below and a width line above. The width line is a line of between about 10 inches and 12 inches. The width line couples the little finger end and the thumb end, the glove including a height line between the upper and lower edges perpendicular with respect to the width line and crossing a central extent of the width line with the lower portion of the height line beneath the width line being between about 4 inches and 6 inches and the upper portion of the height line above the width line being shorter than the lower portion. The enlarged pocket is adapted to increase the area on the glove for deflecting a ball to be caught by two hands of a player and facilitating the development of soft hands and wrists.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A practice glove system comprising:

a glove having fingers with a spaced thumb and an arcuate lower edge with a hand opening centrally and with upwardly projecting side edges;

a web secured between the thumb and the fingers forming with the fingers and the thumb an arcuate upper edge;

an insert with limited flexibility in an arcuate configuration secured within the glove, the insert having ends with a width line between the ends; and an enlarged pocket in the glove with a stiffener below and an additional width line above;

wherein the insert fabricated of a plastic material with limited flexibility in an arcuate configuration, the insert having a continuous arcuate radially interior edge and a continuous arcuate radially exterior edge with a continuous arcuate centerline equally spaced between the interior and exterior edges, the interior and exterior edges being equally spaced along their entire lengths to defining a length about 30 to 38 times a width of either thereof.

2. A practice glove system comprising:

a glove having fingers with a spaced thumb and an arcuate lower edge with a hand opening centrally and with upwardly projecting side edges;

a web secured between the thumb and the fingers forming with the fingers and the thumb an arcuate upper edge;

an insert with limited flexibility in an arcuate configuration secured within the glove, the insert having ends with a width line between the ends; and an enlarged pocket in the glove with a stiffener below and an additional width line above; wherein the insert fabricated of a plastic material with limited flexibility in an arcuate configuration, the insert having a continuous arcuate radially interior edge and a continuous arcuate radially exterior edge with a continuous arcuate centerline equally spaced between the interior and exterior edges, the interior and exterior edges being equally spaced along their entire lengths to defining a length about 30 to 38 times of a width of either thereof; and wherein the glove includes a height line between upper and lower edges perpendicular with respect to the additional width line and crossing a central extent of the additional width line with a lower portion of the height line beneath the additional width line being between about 4 inches and 6 inches and an upper portion of the height line above the additional width line being shorter than the lower portion.

* * * * *